US006196857B1

(12) United States Patent
Fong

(10) Patent No.: US 6,196,857 B1
(45) Date of Patent: Mar. 6, 2001

(54) DETACHABLE COMPUTER LOCK

(76) Inventor: James Woo Fong, 109 Oxford Rd., Newton Center, MA (US) 02159

( * ) Notice: Subject to any disclaimer, the term of this patent is extended or adjusted under 35 U.S.C. 154(b) by 0 days.

(21) Appl. No.: 09/078,004

(22) Filed: May 13, 1998

Related U.S. Application Data

(60) Provisional application No. 60/079,987, filed on Mar. 24, 1998.

(51) Int. Cl.[7] ..... H01R 13/62
(52) U.S. Cl. ..... 439/304
(58) Field of Search ..... 439/133, 134, 439/304

(56) References Cited

U.S. PATENT DOCUMENTS 4,669,281 * 6/1987 Young ..... 439/304 X
5,108,297 * 4/1992 Hoffman et al. ..... 439/134
5,220,815 * 6/1993 Davidge et al. ..... 439/133 X
5,277,600 * 1/1994 Meixler ..... 439/134

* cited by examiner

*Primary Examiner*—Khiem Nguyen
(74) *Attorney, Agent, or Firm*—John L. Chatalas

(57) ABSTRACT

A detachable anti-theft device is disclosed for securing a peripheral computer component to a fixed object. The device includes a connector having a jack that releasably mates with one of the available port plugs of the component. The connector receives a cable that attaches the connector to the fixed object and a locking mechanism keeps the connector jack securely engaged with the peripheral plug so that the component may not be separated from the fixed object. A preferred anti-rotation screw is further included to secure the connector to the plug.

3 Claims, 3 Drawing Sheets

(Device 10)

(Connector 12)

(Device 10)

(Device 10)

(Connector 12)

DETACHABLE COMPUTER LOCK

This application claims priority from U.S. Provisional Application Ser. No. 60/079,987, filed Mar. 24, 1998 entitled "Lockable Computer Screws" which referenced and enclosed 09,078,004 filed Mar. 17, 1998 entitled "Detachable Computer Lock", by the present inventor. The entire disclosures of these applications are hereby incorporated by reference and relied upon.

TECHNICAL FIELD

The present invention relates generally to detachable anti-theft devices, particularly those adapted for securing computer peripherals, especially a laptop computer, against theft.

BACKGROUND

A major threat experienced by owners of portable "laptop" computers is the high incidence of theft. This can also be a problem associated with desktop computer equipment made generally accessible to multiple users and thus to erstwhile thieves, such as equipment stationed, for example, in unlocked offices, in public institutions such as schools and libraries, and in commercial retail store displays. Because of the relative ease with which valuable personal computer systems can be speedily dismantled, particularly laptops, some have attempted to devise means for at least discouraging their theft.

One approach has been to provide a retaining ring, either integrally formed in the computer case or later adhered to the case using a permanent adhesive, through which ring a cable is passed and secured around an immovable object then padlocked in a manner similar to a bicycle chain.

An example of such an adhered device is sold as "The Notebook-Kit™" by Qualtec Data Products, Fremont, Calif. A disadvantage is that such a ring can alter the profile of the computer case, especially a laptop that the user needs to closely fit into a defined space within its carrying luggage. Moreover, the best place to glue the ring may not be the most conveniently accessible place on the component to the user. Further, the chain needs to be taken out of the ring separately before and after each deployment. Because anti-theft measures, like other preventive deterrents, need to be used habitually to be effective, simplification of the above devices and their procedural steps would seem to encourage compliance by the user.

Another approach is for the original equipment manufacturer (OEM) of the laptop case to provide a built-in slot for accepting an after market kit that includes a ring that snaps into the slot and locks a cable to a fixed object. Although some OEM's do offer cases having this type of custom slot, there is still the need to provide a device for those cases not made to accommodate such a device.

Another type of device offered to users is an adapter that fits into the floppy disk drive, connected to a cable and locking with a key; however, many laptops have modular removable floppy drives that snap into place. Because the floppy drive could easily be removed, together with the locked device, such an approach would not deter a thief.

Accordingly, there remains a need for an anti-theft device that is adapted to fit existing peripheral hardware structures, without requiring custom OEM cases. Moreover, there is a need for such a device that is readily accessible and simple to use, which does not alter the footprint of the case.

SUMMARY OF THE INVENTION

According to the present invention, there is provided a detachable anti-theft device for securing a computer component to a fixed object. The device includes a connector that releasably mates with one of the available ports of the component. The connector has first means for receiving a cable that attaches the connector to the fixed object and second means for locking the connector in mating engagement with one of the ports so that the component may not be separated from the fixed object.

In a preferred embodiment of the invention, the second means includes a pair of fasteners each having a driven end that engages the port and a driving end with an anti-rotation head.

In another preferred embodiment the first means includes a cable with opposed ends, the second means being provided with an anchorage for one end of the cable wherein the other end of the cable is passed around the fixed object and the cable is affixed to itself.

In another embodiment of the invention, the connector is adapted to engage another, functional port plug and allow the port to be utilized while the connector is securely in place.

An advantage of the present invention is that the anti-theft device can be easily removed with a minimum of steps during each desired use.

Another advantage of the present invention is an after-market device requiring no permanent attachment to or alteration of the case housing the computer peripheral.

A further advantage of the instant device is its accessibility to the user, via the existing original plug structures already present in the peripheral component.

Other objects and advantages will become apparent to those skilled in the art from the ensuing Detailed Description wherein numbered designations in the Figures of the Drawings correspond to like reference numerals in the text of the Description.

DETAILED DESCRIPTION

Figure 1:
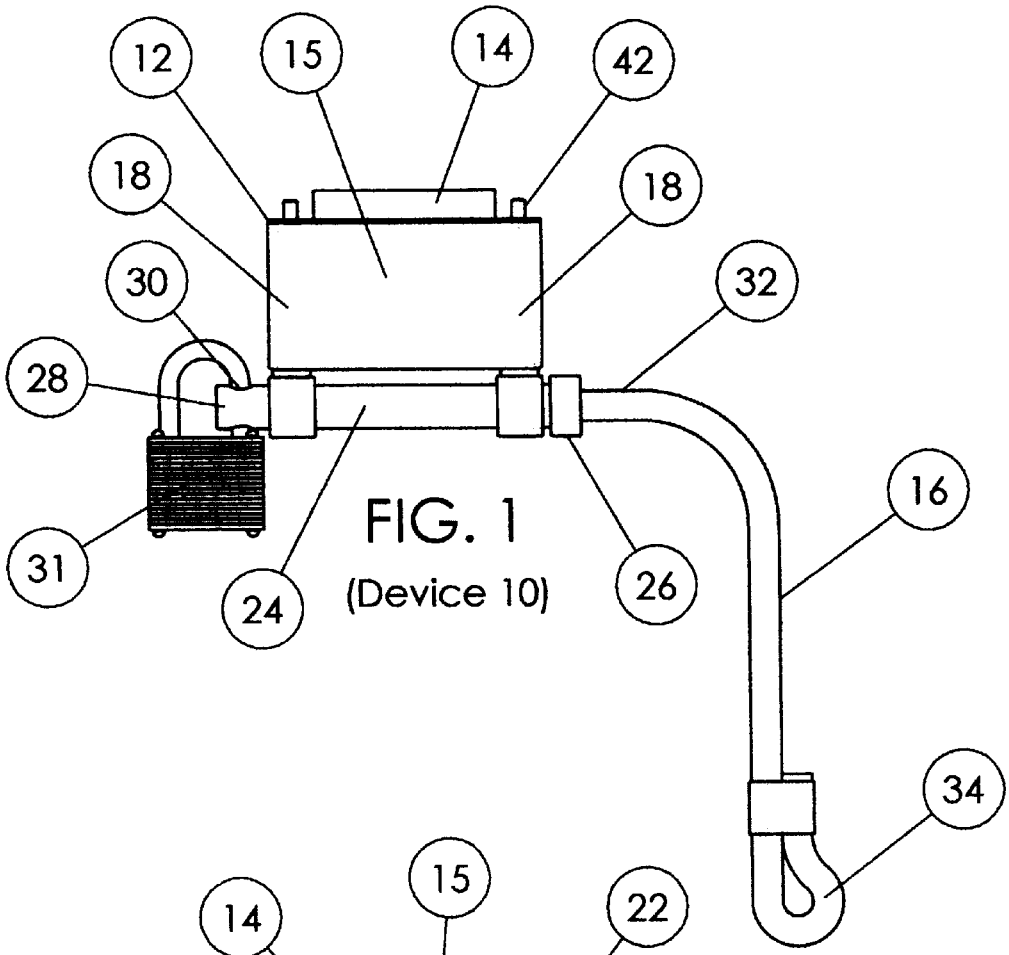
FIG. 1 is a top view of the device of the present invention.
Figure 3:
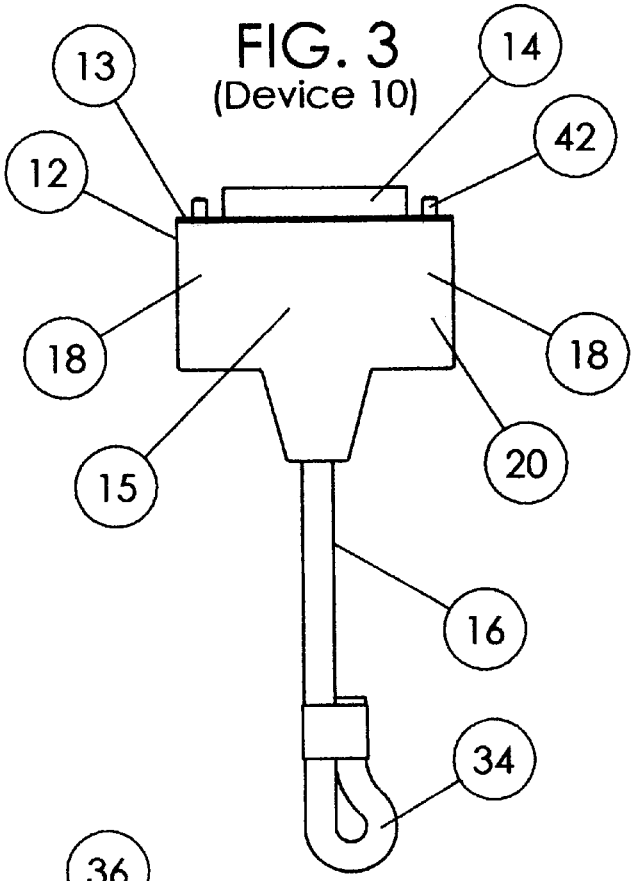
FIG. 3 is a top view of an alternative anti-theft device of the present invention, showing an integral attachment cable and a connector with fasteners having keyed anti-rotation heads.
Figure 7:
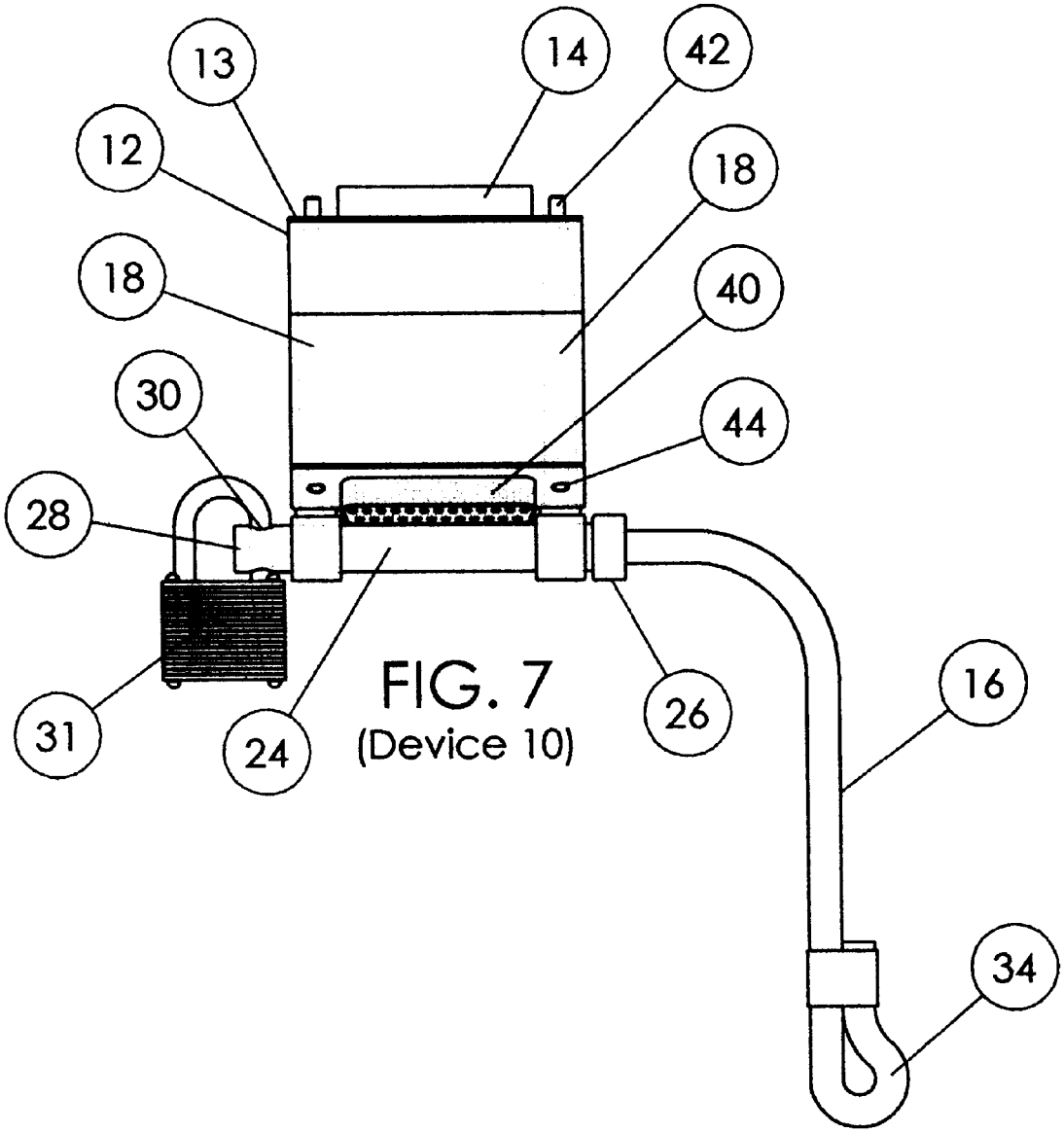
FIG. 7 is a top view of an alternative anti-theft device showing a connector presenting an adapter for simultaneous use of the peripheral port while the present device is deployed.
Figure 8:
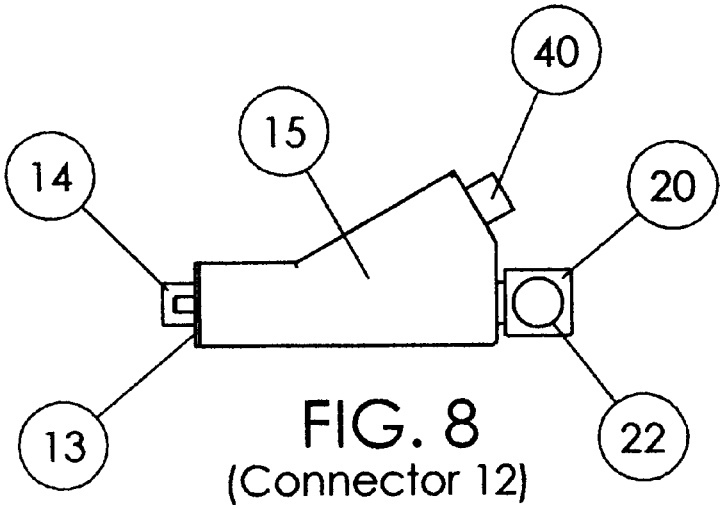
FIG. 8 is a side view of the connector of FIG. 7.

According to the present invention there is provided an anti-theft device, generally shown at 10 in FIGS. 1, 3 and 7, for securing a computer peripheral component (not shown) to a fixed location, for example, an object such as a table or chair (also not shown) that is relatively immobile. Typically, the component houses a central processing unit, such as a desktop or laptop case; however, other individual components secured against theft could be monitors, printers or scanners. In the case of a mobile laptop, of course, there is but a single functional component with which a mobile user is concerned. Accordingly, device 10 is particularly suited for use with a laptop, although adaptable to other desktop components.

The device includes a removable connector 12 having one end 13 with a jack 14 that releasably mates with one of the available serial, parallel or video ports (not shown) of the peripheral component. Connector 12 preferably defines body 15 with a generally rectangular cross-section that mimics the shape of a regular cable plug. Body 15 is preferably made of metal, such as aluminum. Alternatively, a dummy port (not shown) could be installed by the user in any available empty slot of the peripheral, presenting a non-functional plug to which the jack 14 of the connector 12 can be secured. The connector 12 is provided with a first means for receiving a cable 16, such the cable shown in FIGS. 1, 3 and 7, that attaches connector 12 to the fixed object, as will be described. Second means are provided for locking the connector in mating engagement with the peripheral plug, such that the component may not be separated from the fixed location. This locking means will be hereafter described, in various preferred embodiments.

Figure 2:
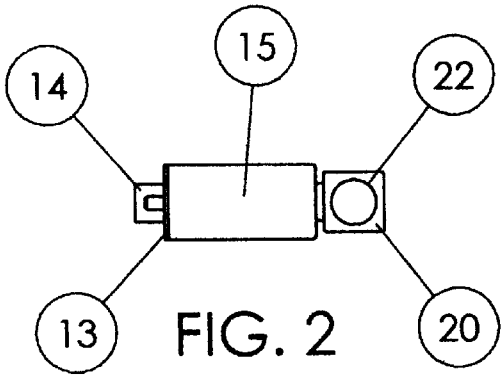
FIG. 2 is a side view of the connector shown in FIG. 1, including the anti-rotation fastener heads of the present invention.
Figure 1A:
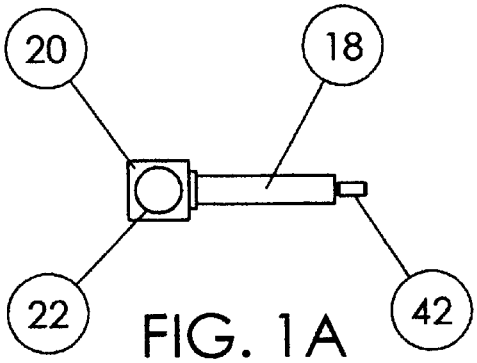
FIG. 1A is a side view of the anti-rotation fastener of FIG. 1.

FIG. 1 shows device 10, including connector 12 (FIG. 2) with a pair of screws 18 having anti-rotation heads 20 with respective corresponding apertures 22 (FIG. 1A) through which a pin 24 is commonly received and secured. The pin 24 has a head 26 and an opposite end 28 with a transverse aperture 30 for receiving a padlock 31. One end 32 of cable 16 is integral with head 26 of pin 24. In use, screws 18 pass through connector 12, are fastened in tapped holes (not shown) in the port structure of the laptop. Then, an opposite looped end 34 of cable 16 is passed around a fixed object and pin 24 is inserted through loop 34, forming a slip-knot. Finally, pin 24 is inserted through both apertures 22 of screws 18 and padlock 31 inserted through aperture 30 to lock the device 10 in place. Alternatively, instead of the slip-knot just described, loop 34 could be brought back all the way to the connector 12 and pin 24 threaded through the loop between screws 18; however, this method would require a longer cable length. When pin 24 is secured in place by padlock 31, the pin is prevented from being removed, while screws 18 are locked together relative to the connector 20 and cannot otherwise be rotated.

Figure 4:
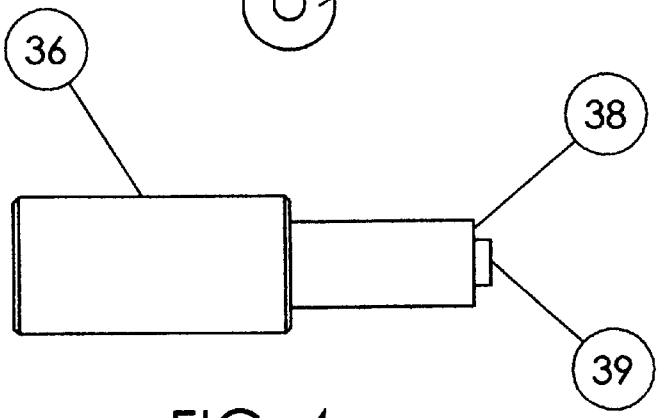
FIG. 4 is a side view of a driver tool used with the keyed anti-rotation heads of FIG. 3.
Figure 6:
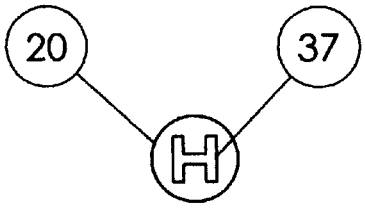
FIG. 6 is an end view of the keyed fastener of FIG. 5.
Figure 5:
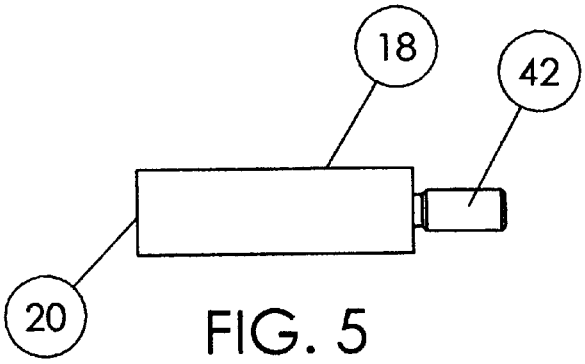
FIG. 5 is an enlarged side view of the keyed fastener of FIG. 4.

FIG. 3 shows an alternative anti-theft device 10 of the present invention, wherein cable 16 is integral with connector 12. In this embodiment, screws 18 have at least one but preferably a pair of uniquely keyed anti-rotation heads 20 removable with a tool 36 having a driven end 38 and bit 39, as shown in FIG. 4. Bit 39 has a shape and size corresponding to the geometry of the head 20. Preferably, several different and unique geometries are possible, to discourage potential thieves from purchasing the kit and using the tool 36. In FIG. 6, a representative geometry of the head 20 corresponding to bit 39 is shown with, e.g., an H-shape. A myriad of other shapes are possible.

In FIG. 7 another alternative embodiment is shown, wherein a connector 12' has an adapter plug 40 allowing the laptop port to be actively used while the connector is deployed. In use, jack 14 is electronically functional and is inserted into the peripheral plug, then a desired plug is inserted into the adapter plug 40 and secured via screw nuts 44. Otherwise, screws 18 are rotated into the peripheral port structure and held in place there by threaded ends 42 of the screws, as in FIGS. 1 and 3. Unlike desktop computers that often have extra available slots, laptops have less of them, hence, all the available slots may be already occupied.

Preferably, screws 18 may utilize one or more associated spacer elements (not shown) at the threaded ends 42 of the screws, to accommodate the jack 14 of connector 12 vis-a-vis the peripheral port.

In summary, there is described a detachable anti-theft device 10 for securing a computer component to a fixed location. A connector 12 has an end 13 with a jack 14 that releasably mates with an available port plug of the component. A cable 16 has one end 32 fixed to the head 26 of pin 24 and an opposite end passed around the fixed location. A pair of uniquely keyed anti-rotation screws 18 fasten connector 12 in mating engagement with the peripheral plug so that the component may not be separated from the fixed location without unlocking the screw heads 20 with a special tool 36.

While applicant has described certain specific embodiments of the invention for illustrative purposes, various modifications will be apparent to those skilled in the art which do not constitute departures from the spirit and scope of the invention as defined in the appended claims. The foregoing description, thus, seeks to be understood in the nature of description rather than limitation. Obviously, many modifications and variations of the present invention are possible in light of the above teachings.

What is claimed is:

1. A detachable anti-theft device for securing a computer component to a fixed location, comprising: a connector that releasably mates with an available port plug of the component, including a pair of keyed fasteners each having an anti-rotation head with an aperture through which a locking pin having a transverse aperture is commonly received, wherein the pin is secured in place by a padlock through the transverse aperture, preventing the pin from being removed whereby the fasteners cannot be rotated.

2. A detachable anti-theft device for securing a computer component to a fixed location, comprising: a connector having an end that releasably mates with an available port plug of the component, a cable, including a pair of keyed fasteners each having an anti-rotation head, the fasteners securing the connector to the plug, each of the anti-rotation heads being specifically keyed by a tool having a corresponding driven end, allowing the associated fastener to be disengaged in a prescribed manner whereby the connector may be removed by the user.

3. An anti-theft kit for a laptop computer, comprising: a connector having an end that releasably mates with an available port of the component, an array of plugs adapted for mating engagement with either of the serial, parallel and video ports of the laptop, a cable having one end attached to the connector, an opposite end adapted to be secured to the fixed location and at least one uniquely keyed anti-rotation screw fastening the connector in mating engagement with the peripheral plug so that the laptop may not be separated from the fixed location, including a tool with a key driver unique to the keyed head of the anti-rotation screw, allowing the associated fastener to be disengaged in a prescribed manner whereby the connector may be removed by the user.

* * * * *